United States Patent [19]

Hawkins, Jr.

[11] 4,080,041

[45] Mar. 21, 1978

[54] ELECTRICAL CONNECTOR

[75] Inventor: John Lawrence Hawkins, Jr., Whittier, Calif.

[73] Assignee: International Telephone and Telegraph Corporation, New York, N.Y.

[21] Appl. No.: 776,964

[22] Filed: Mar. 14, 1977

[51] Int. Cl.[2] ..... H01R 13/42; H01R 13/46

[52] U.S. Cl. ..... 339/196 M; 339/210 M

[58] Field of Search ..... 339/17 LC, 176 M, 176 MP, 339/196 R, 196 M, 206 R, 206 P, 210 R, 210 M, 217 R, 217 PS

[56] References Cited

U.S. PATENT DOCUMENTS

| | | | |
|---|---|---|---|
| 3,409,862 | 11/1968 | Lynch | 339/196 R |
| 3,487,355 | 12/1969 | Cairns | 339/176 M |
| 3,550,066 | 12/1970 | Cootes | 339/196 M |
| 3,905,673 | 9/1975 | Evans | 339/210 M |

FOREIGN PATENT DOCUMENTS

| | | | |
|---|---|---|---|
| 2,348,610 | 4/1975 | Germany | 339/210 M |

*Primary Examiner*—Neil Abrams
*Attorney, Agent, or Firm*—Thomas L. Peterson

[57] ABSTRACT

A right-angle connector for a printed circuit board is disclosed. The connector contacts have tails that are bent at a right angle. A retainer plate is removably mounted on the housing of the connector. The plate embodies openings through which the bent tails of the contacts extend for positioning the tails in a predetermined pattern. The plate also embodies a row of spaced fingers which cooperate with shoulders on the contacts to releasably retain the contacts inside the connector housing.

6 Claims, 6 Drawing Figures

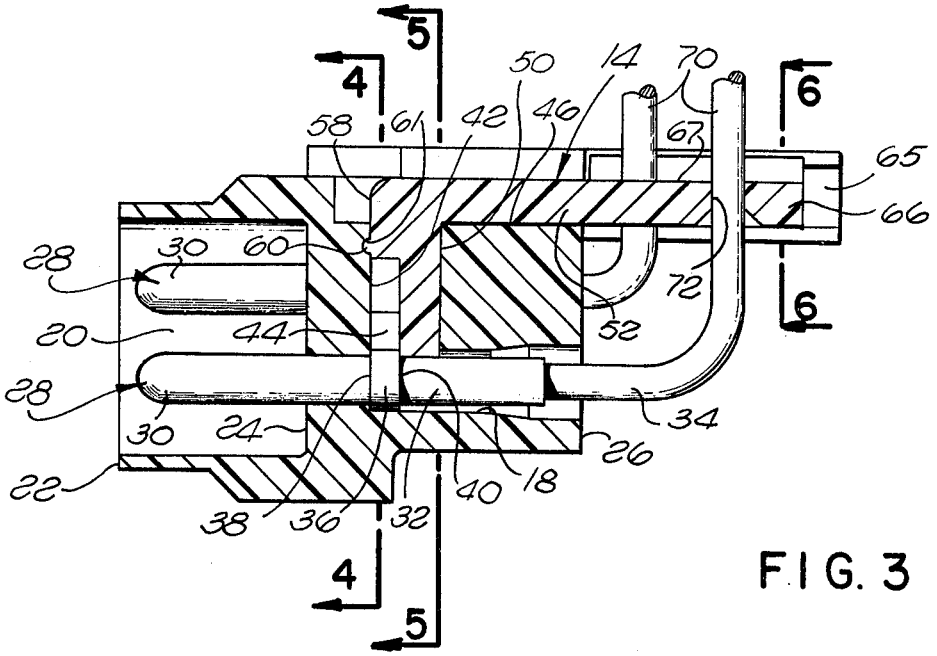
FIG. 3
FIG. 4
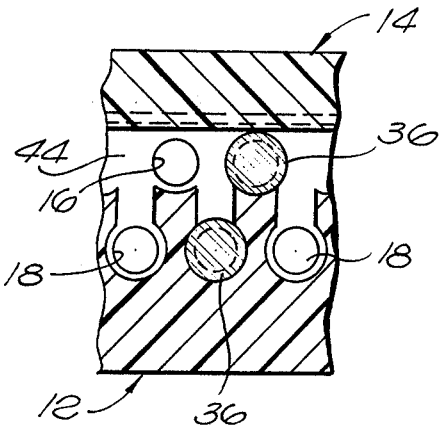
FIG. 5
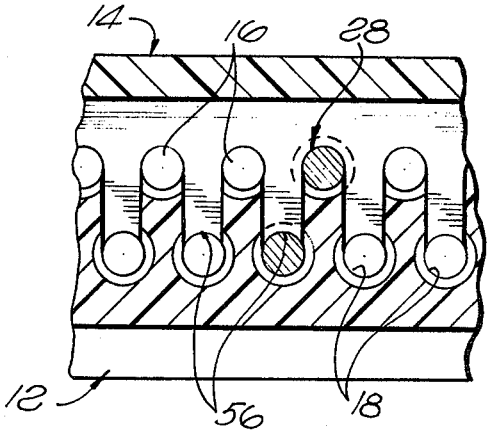
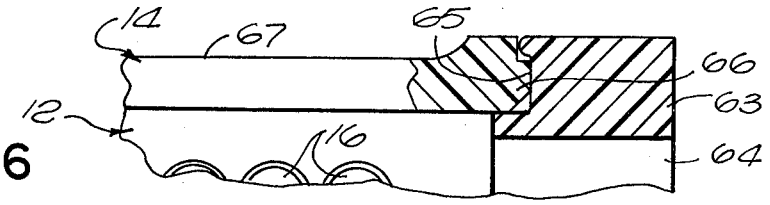
FIG. 6

ELECTRICAL CONNECTOR

BACKGROUND OF THE INVENTION

The present invention relates generally to an electrical connector and, more specifically, to a right-angle connector for printed circuit boards, and to a contact retention arrangement for such a connector which may also be utilized for other forms of connectors.

Right-angle connectors for printed circuit boards are well

Right-angle connectors for printed circuit boards are well known in the art. One form of such a connector comprises a molded plastic connector housing typically having two rows of cavities containing contacts therein that have rearwardly extending termination tails. The tails extend rearwardly from the connector housing and are bent at a right angle such that when the connector is mounted on a printed circuit board the ends of the tails will extend into openings in the board where they may be soldered to the board. An integral flange on the rear of the housing is formed with spaced vertically extending slots in which the bent tails of the contacts are fitted for supporting and properly positioning the tails to match the pattern of openings in the printed circuit board. Such connector has the disadvantage that the support for the contact tails is provided at a point adjacent to the bend in the tails, rather than near the ends of the tails so that the ends of the tails may not necessarily be reliably retained precisely positioned for fitting in the holes in the printed circuit board.

In another prior art right-angle connector, the connector has a metal plate mounted on brackets secured to a metal shell for positioning the contact tails relatively close to their ends. However, the use of the separate contact positioning plate, brackets, and metal shell on the connector increases its cost. In addition, such prior art connectors embody separate means for releasably mounting the contacts within the connector housing.

It is the object of the present invention to provide an improved connector for printed circuit boards having a reliable support for properly positioning the ends of the tails of the contacts in the connector and contact retention means integral with the contact tail support which will minimize manufacturing costs.

The present invention is also directed to a novel contact retention arrangement which is particularly suited for a connector having two parallel rows of contacts, with the contacts in the two rows staggered relative to each other. It is known in the art to utilize a contact retention plate which is mounted in a connector housing perpendicular to the axes of the contact cavities therein. In one such retention assembly, the contact retention plate has a plurality of parallel slots therein defining spaced fingers. The contacts in the connector are arranged in vertical rows. The retention plate is inserted into a vertical slot in the connector housing. The slots in the plate receive the contacts. The sides of the plate adjacent to the slots engage rearwardly facing shoulders on the contacts to restrict rearward movement of the contacts in their respective cavities. This retention arrangement cannot be utilized for a connector having two rows of contacts with the contacts staggered relative to each other in a plane transverse to the path of movement of the contact retention plate. In another prior art connector, the contact retention plate is formed with two rows of staggered circular openings. A narrow slot extends downwardly from the bottom of each opening. The slots are dimensioned to receive the bodies of the contacts. The sides of the slots engage rearwardly facing annular shoulders on the contacts to restrict rearward movement of the contacts in their respective cavities. The circular openings in the plate are larger than the annular shoulders on the contacts so that when the plate is shifted to a position wherein the contacts are coaxial with the openings, the contacts may be removed from the connector housing. However, in order to remove the plate from the connector housing, the connector must be disassembled.

Another object of the present invention is to provide a unique contact retention assembly in which the retention plate is designed to releasably retain contacts arranged in two rows staggered relative to each other, and which may also be removed from the connector housing without disassembling the connector.

SUMMARY OF THE INVENTION

According to a principal aspect of the present invention, there is provided an electrical connector having a housing containing a plurality of contact cavities each receiving a contact. Each contact has a body portion in its respective cavity and a rear termination portion extending outside the cavity. Such termination portion may be in the form of a solder tail for a printed circuit board. The tail may extend either straight from the contact body or be bent at a right angle relative to the axis of the body. A retainer plate is removably mounted on the connector housing. The plate embodies first means cooperating with the contact termination portions for locating such portions in a predetermined pattern such as, for example, a pattern matching the pattern of plated-through holes in a printed circuit board upon which the connector may be mounted. The retainer plates also embody second means engaging the contact bodies for releasably retaining the contacts in the contact cavities. Thus, it is seen that the retainer plate utilized in the connector of the present invention functions both to position the termination portions or tails of the contacts of the connector and releasably retain the contacts in their cavities in the connector housing. The retainer plate may be a one-peice molded plastic part which is relatively inexpensive to manufacutre. The plate is also arranged to cooperate with the termination portions of the contacts closer to the ends thereof than in prior art plastic connectors so as to provide a more precise positioning of the termination portions in a predetermined pattern.

According to another aspect of the present invention, there is provided a contact retention assembly for an electrical connector in which the connector housing contains two parallel rows of contact cavities, with the cavities in the respective rows staggered relative to each other. A slot in the housng extends lengthwise of the two rows of cavities, intersecting the cavities perpendicular to their longitudinal axes. A contact is mounted in each cavity, and is formed with a rearwardly facing shoulder which is disposed within the slot. A retainer plate having a row of spaced fingers is removably mounted in the slot behind the shoulders on the contacts. The fingers extend between the bodies of the contacts in one row of cavities so that the fingers on opposite sides of each contact body engage the contact shoulder, thereby restricting rearward movement of the contact in its cavity. The end of each finger engages behind the shoulder of each contact in the second row of cavities to restrict rearward movement of the contacts in such cavities. Thus, a single contact retention plate is provided which may releasably retain contacts in a connector housing arranged in two rows staggered relative to each other, and the plate may be removed from the housing without dissassembling the connector.

BRIEF DESCRIPTION OF THE DRAWINGS

FIG. 3 is a transverse vertical sectional view through the connector of the present invention shown with the contact retention plate fully assembled to the connector housing;

FIG. 4 is a fragmentary vertical sectional view taken along line 4—4 of FIG. 3;

FIG. 5 is a fragmentary vertical sectional view taken along line 5—5 of FIG. 3; and FIG. 6 is a partial vertical section taken along line 6—6 of FIG. 3.

DESCRIPTION OF THE PREFERRED EMBODIMENT

Figure 2:
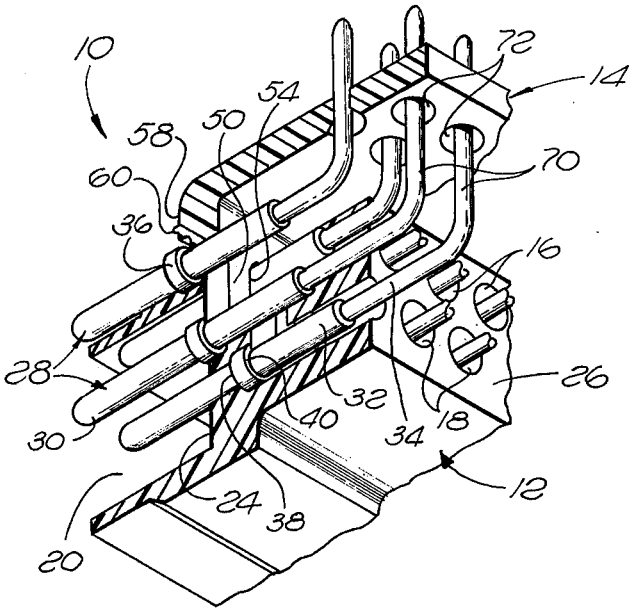
FIG. 2 is a fragmentary perspective sectional view of the connector of the present invention showing how the contacts are maintained in the cavities in the connector housing by the retention plate.

Referring now to the drawings in detail, the connector of the present invention, generally designated 10, includes a housing 12 and a retainer plate 14. The housing and plate may be one-piece integral molded plastic parts. As best seen in FIG. 2, the housing contains a first row of contact cavities 16 and a second row of cavities 18 which is parallel to the first row with the cavities staggered relative to the cavities in the first row. A recess 20 is formed in the front 22 of the connector housing. Each contact cavity extends from the bottom 24 of the recess to the rear 26 of the housing, as seen in FIG. 3.

Figure 1:
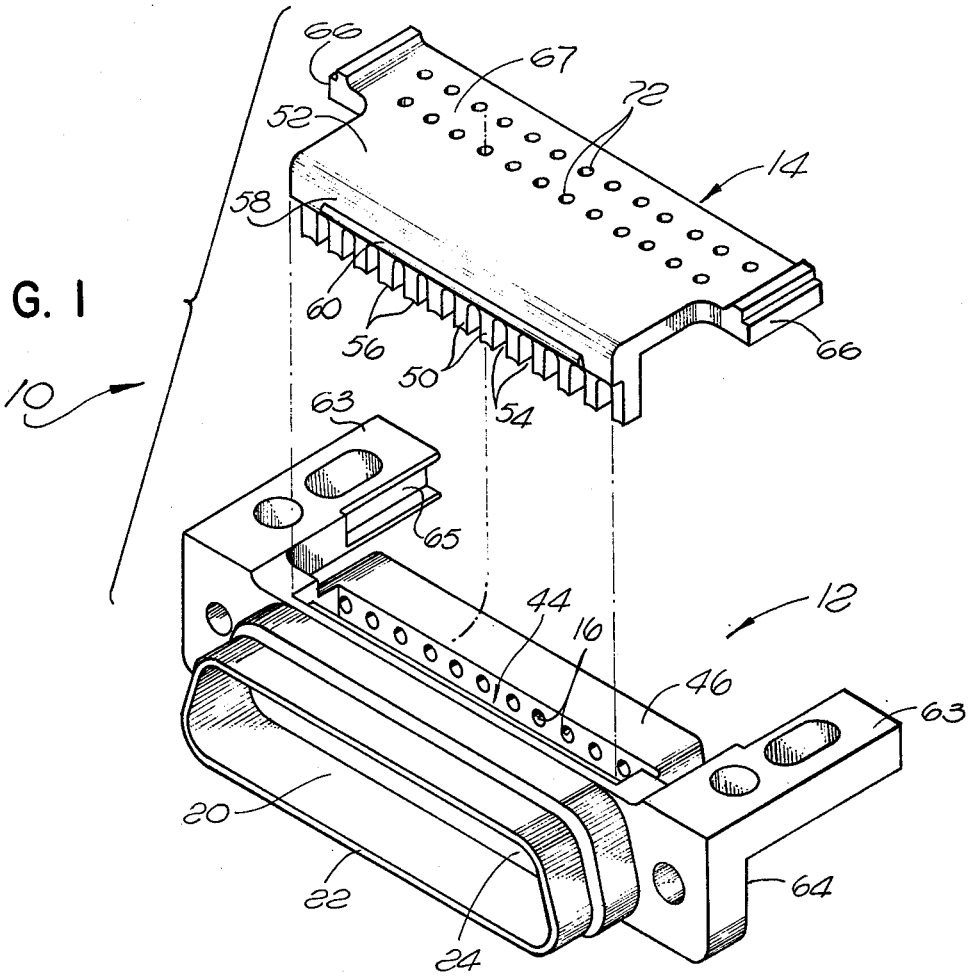
FIG. 1 is an exploded view of the connector of the present invention with the contacts removed therefrom, showing the contact retention plate separated from the connector housing.

A contact, generally designated 28, is mounted in each cavity 16 and 18. The contact has a forward contacting portion 30 which extends into the recess 20, and intermediate body portion 32 in the contact cavity, and a rear termination portion 34 which extends rearwardly from the cavity beyond the rear face 26 of the housing. An annular enlargement 36 is formed on the body portion 32 of each contact. The enlargement provides a forwardly facing shoulder 38 and a rearwardly facing annular shoulder 40. The shoulder 38 engages the front wall 42 of a slot 44 which runs lengthwise of the contact cavities. The slot 44 intersects the cavities 16 and 18 perpendicular to the longitudinal axes of the cavities, and opens at the upper side 46 of the connector housing as viewed in FIGS. 1 and 3. As a practical matter, the side 46 is the bottom of the housing when the connector is mounted on a printed circuit board.

The contacts are mounted in the connector housing by inserting the contacts into the cavities 16 and 18 from the rear 26 of the housing. Forward movement of the contacts in their respective cavities is limited by the engagement of the shoulders 38 on the contacts with the front wall 42 of the slot. In accordance with one feature of the present invention, the retainer plate 14 is provided with a row of spaced parallel fingers 50 which extend perpendicular to the flat base section 52 of the plate. The plate is mounted on the side 46 of the connector housing with the fingers 50 extending into the slot 44 behind the rearwardly facing shouldrs 40 on the contacts. The fingers 50 are spaced apart a distance corresponding to the cross-section of the intermediate body portions 32 of the contacts so that the body portions of the contacts in the cavities 16 will be slidably received in the spaces 54 between the fingers 50, as best seen in FIG. 5. Thus, the two fingers on opposite sides of each contact in the row of cavities 16 will engage the rearwardly facing shoulders 40 on the contacts in such cavities to restrict rearward movement of the contacts therein. The ends of the fingers 50 are formed with arcuate recesses 56. These recesses engage the intermediate body portions 32 of the contacts in the cavities 18 immediately behind the shoulders 40 on the contacts to restrict rearward movement of the contacts in such cavities. Thus, it is seen that a single row of retention fingers 50 is provided on the plate 14 for releasably retaining the two rows of contacts which are staggered relative to each other.

The row of fingers 50 is spaced behind the front edge 58 of the retainer plate 14 a distance corresponding to the axial length of the annular enlargement 36 of the contacts so that the fingers will be positioned behind the shoulders 40 when the fingers are mounted in the slot 44 in the connector housing. A latching rib 60 is formed on the front edge 58 of the plate 14. This rib engages a groove 62 formed in the front wall 42 of the slot 44. A pair of PC board mounting legs 63 extend rearwardly from flanges 64 on opposite ends of the connector housing 12. The legs are formed with inwardly facing grooves 65 which receive the ends of arms 66 that extend outwardly from the opposite ends of the base section 52 of the retainer plate. When the retainer plate is mounted on the connector housing, the rib 60 will snap into the groove 62 and the ends of the arms 66 will snap into the grooves 65 on the mounting legs 60. The plate 14 may be removed from the connector housing by exerting an upward force on the rear portion 67 of the retainer plate. Thus, the retainer plate is removably mounted on the connector housing.

It will be appreciated that the contact retention assembly disclosed herein may be utilized for any connector having two rows of contacts staggered relative to each other, and is not limited to the specific connector construction illustrated in the drawings.

In the preferred embodiment of the invention disclosed herein, the rear termination portions or tails 34 of the contacts are bent at right angles to provide vertically extending terminal ends 70 which are parallel to the fingers 50 on the retainer plate and to the slot 44 in the connector housing. Two rows of openings 72 are provided in the rear portion 67 of the retainer plate. The pattern of the openings 72 corresponds to the pattern of holes in a printed circuit board (not shown) on which the connector is to be mounted. The terminal ends of the contacts extend through the openings 72. Since the retainer plate is mounted on the side 24 of the connector hosuing, the plate is located a substantial distance from the bends in the tails of the contacts and thus relatively close to the ends of the contacts. As a consequence, the retainer plate serves to accurately support and position the contact tails close to their ends, thus assuring that they will be properly located for mounting into the holes in the printed circuit board. Since the contact tail retainer plate 14 is a separate part from the connector housing, its length may be varied depending upon the axial length of the contact tails. As a consequence, the same connector housing may be utilized with retainer plates having different lengths to accommodate different length contact tails, thus minimizing the tooling costs which would otherwise be encountered if the retainer plate were integral with the housing 12.

In order to mount the retainer plate 14 on the housing 12, the terminal ends 70 of the contacts are first threaded into the openings 72 in the plate and, thereafter, the plate is pushed downwardly to cause the contact retention fingers 50 to enter into the slot 44 in the housing so as to engage behind the shoulders 40 on the contacts to retain the contacts in the housing. Thus, by the present invention, the single retainer plate 40 serves the dual function of releasably retaining the contacts in the connector housing and properly positioning the terminal ends of right-angle contact tails to facilitate insertion thereof into holes in a printed circuit board. It will be appreciated that if the tails of the contacts were coaxial with the contact bodies, rather than bent at right-angles as shown in the drawings, the rear portion 66 of the retainer plate could be elminated and the front portion with the fingers 50 utilized simply to releasably retain the contacts in the housing.

What is claimed is:

1. An electrical connector comprising:

a one-piece integral molded connector housing having first and second parallel rows of contact cavities therein each receiving a contact;

said cavities in said two rows being staggered relative to each other;

a slot in said housing extending lengthwise of said rows and intersecting said cavities perpendicular to their longitudinal axes;

each said contact having a body portion formed with a rearwardly facing shoulder lying in said slot;

a retainer plate having a row of spaced fingers in said slot, said fingers extending between said body portions of said contacts in said first row;

the pair of fingers on opposite sides of each said contact in said first row engages said contact shoulder to restrict rearward movement of said contact in its respective cavity; and the end of each said finger engages behind said shoulder of a corresponding contact in said second row to restrict rearward movement of said contact in its respective cavity.

2. An electrical connector comprising:

a one-piece integral molded housing have a plurality of contact cavities therein each receiving a contact;

each said contact having a body portion in its respective cavity and a termination portion extending outside of said cavity;

the termination portion of each said contact is bent at a right-angle relative to the body portion of said contact to provide a terminal end;

a retainer plate removably mounted on said housing, each retainer plate having a flat base section;

a plurality of openings in said base section each receiving one of said terminal ends for locating said terminal ends in a predetermined pattern;

said retainer plate embodying means engaging said contact bodies for releasably retaining said contacts in said cavities;

said means comprising contact retention elements on said base section extending perpendicular thereto;

said housing having a slot therein parallel to said terminal ends and intersecting said cavities, said slot opening at the side of said housing facing in the direction of the bend of said termination portions of said contacts; and said retention elements extend into said cavities through said slot.

3. An electrical connector as set forth in claim 2 wherein:

said housing embodies two rows of said cavities, each said cavity in said two rows receiving one of said contacts; and said contact retention elements engage the contact bodies of said contacts in both said rows for releasably retaining said contacts therein.

4. An electrical connector as set forth in claim 3 wherein:

said cavities in said two rows are staggered relative to each other.

5. An electrical connector as set forth in claim 2 wherein:

said contact cavities are arranged in a row;

said contact retention elements comprise a row of spaced fingers, said fingers extending between said body portions of said contacts in said row of cavities;

each said contact body portion has a rearwardly facing shoulder; and the pair of fingers on opposite sides of each said contact engages said contact shoulder to restrict rearward movement of said contact in its respective cavity.

6. An electrical connector as set forth in claim 2 wherein:

said contact cavities are arranged in first and second parallel rows;

said cavities in said two rows are staggered relative to each other;

each said contact body portion has a rearwardly facing shoulder;

said contact retention elements comprise a row of spaced fingers, said fingers extending between said body portions of said contacts in said first row;

the pair of fingers on opposite sides of each said contact in said first row engages said contact shoulder to restrict rearward movement of said contact in its respective cavity; and the end of each said finger engages behind said shoulder of a corresponding contact in said second row to restrict rearward movement of said contact in its respective cavity.

* * * * *